US007703318B2

(12) United States Patent
Jacobson et al.

(10) Patent No.: US 7,703,318 B2
(45) Date of Patent: Apr. 27, 2010

(54) PERMANENTLY ECCENTERED FORMATION TESTER

(75) Inventors: Aaron Jacobson, Paris (FR); Stéphane Briquet, Clamart (FR)

(73) Assignee: Schlumberger Technology Corporation, Sugar Land, TX (US)

( * ) Notice: Subject to any disclaimer, the term of this patent is extended or adjusted under 35 U.S.C. 154(b) by 174 days.

(21) Appl. No.: 10/543,426

(22) PCT Filed: Jan. 19, 2004

(86) PCT No.: PCT/EP2004/000404

§ 371 (c)(1),
(2), (4) Date: Jul. 26, 2005

(87) PCT Pub. No.: WO2004/067913

PCT Pub. Date: Aug. 12, 2004

(65) Prior Publication Data

US 2006/0150726 A1 Jul. 13, 2006

(30) Foreign Application Priority Data

Jan. 30, 2003 (GB) ..... 0302133.4

(51) Int. Cl.
*E21B 47/06* (2006.01)

(52) U.S. Cl. ..... 73/152.51; 166/250.17

(58) Field of Classification Search ..... 73/152.51, 73/152.22; 166/250.01, 250.17
See application file for complete search history.

(56) References Cited

U.S. PATENT DOCUMENTS 3,079,793 A * 3/1963 Le Bus et. al. ..... 73/152.26
3,147,807 A * 9/1964 Whitten ..... 175/4
3,530,933 A 9/1970 Whitten et al. ..... 166/100
3,565,169 A * 2/1971 Bell ..... 166/100
3,724,540 A 4/1973 Urbanosky et al. ..... 166/100
3,762,472 A 10/1973 Alexander, Jr. ..... 166/241.6
4,210,018 A * 7/1980 Brieger ..... 73/152.26
4,339,948 A * 7/1982 Hallmark ..... 73/152.26
4,375,164 A 3/1983 Dodge et al. ..... 73/152.12
4,745,802 A * 5/1988 Purfurst ..... 73/152.26
4,879,900 A * 11/1989 Gilbert ..... 73/152.26
4,884,439 A * 12/1989 Baird ..... 73/152.24

(Continued)

FOREIGN PATENT DOCUMENTS

EP 0 089 892 9/1983

(Continued)

*Primary Examiner*—Hezron Williams
*Assistant Examiner*—Tamiko D Bellamy
(74) *Attorney, Agent, or Firm*—Myron K. Stout

(57) ABSTRACT

A formation tester for determining the formation pressure of a subsurface formation traversed by a wellbore comprises of:—an elongate tester body;—a support plate (3) that is extendible outwardly from the surface of the formation tester body, said support plate carrying probe means (5) to establish a passageway between the inside of said formation tester body and said formation, and a sealing pad (6) connected to said probe means to isolate said passage way between the inside of said formation tester body and said formation;—anchoring means (7) to settle said tester body at a level within the wellbore. The elongate tester body comprises an eccentric portion (2) wherein said support plate is mounted such that a determined standoff is maintained between said elongate tester body and the wall of the wellbore when said tester body is settled at a level in the wellbore.

17 Claims, 1 Drawing Sheet

U.S. PATENT DOCUMENTS 5,056,595 A * 10/1991 Desbrandes ..... 166/100
5,065,619 A * 11/1991 Myska ..... 73/152.24
5,207,104 A * 5/1993 Enderlin ..... 73/784
5,233,866 A 8/1993 Desbrandes ..... 73/152.05
5,796,252 A * 8/1998 Kleinberg et al. ..... 324/303
6,026,915 A * 2/2000 Smith et al. ..... 175/50
7,152,466 B2 * 12/2006 Ramakrishnan et al. .. 73/152.51
2005/0217848 A1 * 10/2005 Edwards et al. ..... 166/285

FOREIGN PATENT DOCUMENTS

GB 1 460 981 1/1977
GB 2 090 891 7/1982

* cited by examiner

PERMANENTLY ECCENTERED FORMATION TESTER

The present invention relates generally to the field of oil and gas exploration. More particularly, the invention relates to a permanently eccentered formation tester for determining at least one property of a subsurface formation penetrated by a wellbore.

Over the past several decades, highly sophisticated techniques have been developed for identifying hydrocarbons, commonly referred to as oil and gas, from subsurface formation. These techniques facilitate the discovery, assessment and production of hydrocarbons from subsurface formations.

When a subsurface formation containing an economically producible amount of hydrocarbons is believed to have been discovered, a borehole is typically drilled from the earth surface to the desired subsurface formation and tests are performed on the formation to determine whether the formation is likely to produce hydrocarbons of commercial value. Typically, tests performed on subsurface formation involve interrogating penetrated formations to determine whether hydrocarbons are actually present and to assess the amount of producible hydrocarbons therein. These preliminary tests are conducted using formation testing tools. These formation testing tools are typically lowered into a wellbore by a wireline cable, tubing, drill string or the like and may be used to determine various formation characteristics which assist in determining the quality, quantity and conditions of the hydrocarbons or other fluids located therein. Other tools may form part of drilling tool, such as drill string for the measurement of formation parameters during the drilling process.

Formation testing tools usually comprise cylindrical bodies adapted to be lowered into a borehole and positioned at a depth in the borehole adjacent to the subsurface formation for which data is desired. Once positioned in the borehole, these tools are placed in fluid communication with the formation to collect data from the formation. In order to establish such fluid communication, a probe, snorkel or other device is sealed against the borehole wall.

Formation testing tools, also called formation testers, are used to measure downhole parameters such as wellbore pressures, formation pressures, and formation mobilities among others. They may also be used to collect samples from a formation so that the types of fluid contained in the formation and other fluid properties can be determined. The formation properties retrieved during a formation test are important factors in determining the commercial value of a well and the manner in which hydrocarbons may be recovered from it.

However, retrieving such formation properties with a formation tester may cause some problems. The pressure of the wellbore fluid, also referred to as mud, must be maintained at a higher level than the pressure of the formation, to prevent the formation fluid from flowing out of the formation and rising very quickly to the surface. Various chemical constituents are added to the mud to increase its density and overall weight, and increase the pressure of the wellbore fluid, referred to as the hydrostatic pressure or mud pressure. The difference between the mud pressure and the formation pressure is referred to as the pressure differential. This difference can be as high as 5000 psi, but is most often 2000 psi or less. If the pressure differential is positive, then fluid and solid content of the mud will tend to flow into the formation. If the pressure differential is negative, then fluid and solid content of the formation will tend to flow from the inside of the formation to into the wellbore and upwards towards the surface. If a positive differential pressure is maintained, then wellbore fluid and solid particles will flow from the wellbore into the formation, and the solid particles will stack up against the wall of the wellbore. Over time, these stacked particles will create a seal between the wellbore and the formation, said seal being referred to as the mudcake. If the mudcake is removed from the wall of the wellbore, and if a positive differential pressure still exits, then the contents of the wellbore again will begin to flow into the formation and a new mudcake will be formed. The mudcake can be up to ½ inch or greater in thickness, depending on the permeability of the formation, mud type, drilling operations and procedures and pressure differential.

If the mudcake is removed or disturbed while a formation tester is lowered into the well, then the formation tester can be drawn towards the wall of the wellbore due to the differential pressure and become stuck to said wall. The phenomenon is known as differential sticking. The probability for the tester to be differentially stuck is proportional to four main variables: area of mudcake that has been removed or disturbed, amount of positive differential pressure, surface area of the tester that is in contact with the area of removed mudcake and time the formation tester surface area is in contact with area of removed mudcake.

Formation testers known in the state of the art have a significant risk of becoming differentially stuck. This risk can mainly be attributable to the large size and length of formation testers and the tendency of this tool to remove the mudcake while being lowered into the well. This risk is also due to poor positioning of the formation testers in the wellbore, such that large surface of the tool can be in contact with the area of removed mudcake. This poor positioning is due to usual tool design that comprises, on one side of the tool, an anchor to set the tool in place at a certain level in the well and opposite to the anchor, a probe that will perform the measurements. The probe and anchor forces are traditionally identical and exactly opposing. Furthermore, the probe and anchor are able to extend independently of the formation tester body that can consequently be positioned at any point between the extended probe and anchor. It is thus possible of the entire tester body to be positioned against the wall of the wellbore where the mudcake may have been removed while lowering the tool, which drastically increases the risk of being stuck while performing a measurement.

Large rings or standoffs have been used to provide a space or standoff between the tool body and the wall of the wellbore, in order to minimize the risk of sticking. The purpose of these standoffs is to prevent the tool from directly contacting an area of removed mudcake. Document U.S. Pat. No. 5,233,866 discloses a tester wherein a pad provided with measurements means on a support plate can be extended simultaneously with anchoring means in order to contact the wall of the borehole. In its extended position, this pad may allow a standoff between the entire tool body and the wall of the borehole.

The drawback of these tools is that the standoffs are not integral portion of the tool body but are bolted, threaded or strapped into the tool body. As a result, they can fall or be torn from the tool body during use in the wellbore. Metal debris falling to the bottom of the wellbore will interfere with the drilling and other development operations of the well. They would consequently need to be removed by a costly and time consuming process. Furthermore, in many cases while using this tool, due to the fact that there is no imbalance between the probe and anchor forces, the tool body can consequently be positioned at any point between the extended probe and anchor. The tool body may therefore be entirely pressed against the surface of the wellbore, increasing the risk of differential sticking.

It thus remains a need to eliminate the risk of differential sticking while performing pretests with a device avoiding any inconvenience of testers known in the art. It is thus an object of the invention to propose a formation tester for determining the formation pressure of a subsurface formation traversed by a wellbore, said formation tester comprising:

an elongate tester body;

a support plate that is extendible outwardly from the surface of the formation tester body; said support plate carrying probe means to establish a passageway between the inside of said formation tester body and said formation, and a sealing pad connected to said probe means to isolate said passage way between the inside of said formation tester body and said formation;

anchoring means to settle said tester body at a level within the wellbore.

According to the invention, said elongate tester body comprises an eccentric portion wherein said support plate is mounted such that a determined standoff is maintained between said elongate tester body and the wall of the wellbore when said tester body is settled at a level in the wellbore.

Due to the determined standoff, the amount of tool surface area in contact with an area of disturbed or removed mudcake will be drastically minimized, which will subsequently minimize the chance of becoming differentially stuck to the side of the wellbore while performing a pressure measurement. This feature thus enables to perform quicker and safer pressure measurements (or any other measurement like taking fluid samples for example) in the wellbore.

In a preferred embodiment for the formation tester of the invention, said tester further comprises probe positioners that are mounted on a first side of said eccentric portion and extend the support plate outwardly from the surface of the formation tester body towards the wall of the wellbore. Furthermore, the anchoring means are situated on the side of the tester body opposite to the support plate and there is an imbalance between the anchoring force and the force applied by the probe positioners.

Thanks to the imbalance between the probe positioners force and the anchoring means force, one can properly settle the tool inside the wellbore at the measurement level and make sure that the tool is always positioned in the well such that the only contact with the wall of the wellbore will be the eccentric portion surface. This feature will thus enable, even in deviated or horizontal wells to minimize the risk of the tool to remain stuck at the measurement level.

According to a preferred embodiment of the formation tester of the invention, a hydraulic circuit actuates the probe positioners and the anchoring means, said hydraulic circuit being designed to minimize the time needed to extend the support plate and settle the tool body. Furthermore, the probe positioners and the anchoring means comprise pistons connected to said hydraulic circuit, the pistons from said probe positioners being of smaller diameter than the diameter of the pistons from said anchoring means.

This feature enables in a very simple way to provide a mechanical force imbalance between the probe side and its opposite side in order to make sure that the tool is always positioned in such a manner that the eccentric portion of the tool body contacts the wall of the well when a pressure measurement is performed.

Advantageously, the eccentric portion of the tester body is an integral part of the elongate tester body. The fact that the eccentric portion is integral to the tool body, and is not fastened to said tool body by any additional parts enables to maintain a constant standoff between the tool and the borehole wall in any case. Furthermore, this feature prevents this eccentric portion from being modified or lost in the wellbore. This standoff must be significant enough to exceed the thickness of most mudcakes. Typically, the standoff will be at least half of an inch.

It is also proposed to provide a method for performing a formation pressure test of a subsurface formation traversed by a wellbore, said method comprising the following steps:

lowering an elongate formation tester body inside said wellbore;

stopping said formation tester body at a level wherein a pressure test is to be performed;

extending a support plate at said level, outwardly from the surface of the formation tester body towards the wall of the wellbore;

extending anchoring means to settle said formation tester body in the wellbore;

pressing a sealing pad and probe means carried by said support plate against the wall of the wellbore to establish a passageway between the inside of said formation tester body and said formation and isolate said passageway from the wellbore;

performing a formation pressure test, characterized in that the method further comprises the step of maintaining a determined standoff between the formation tester body and the wall of the wellbore, against which said probe and sealing pad means are pressed, by means of an eccentric portion of said formation tester body.

Additional objects and advantages of the invention will become apparent to those skilled in the art upon reference to the detailed description taken in conjunction with the provided figures.

Figure 1:
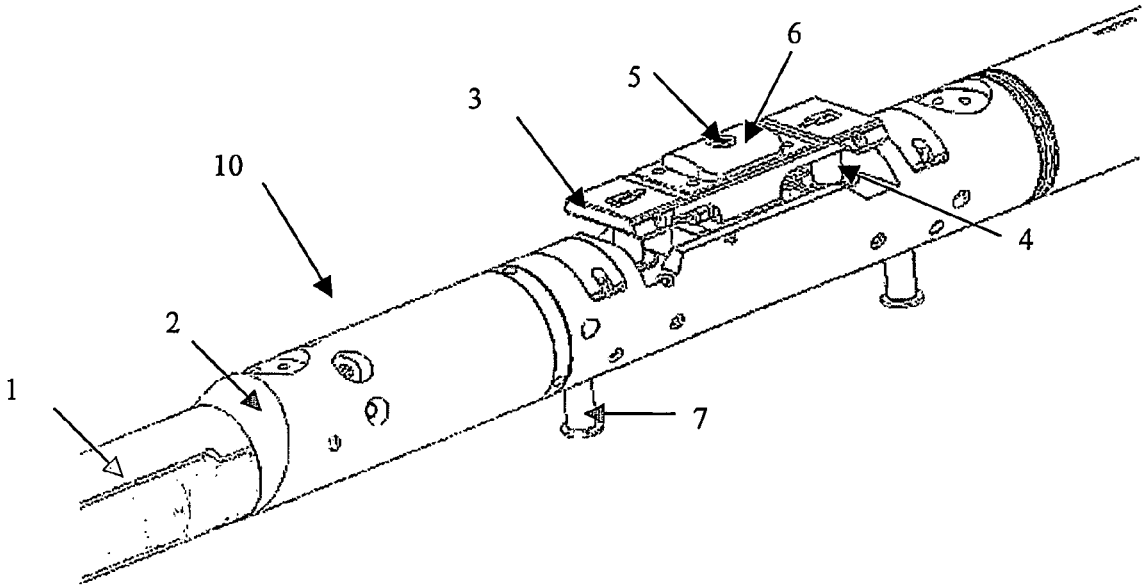
FIG. 1 represents a eccentric view of the formation tester according to the invention, said view being focused on the eccentric portion of the tool body.

As it can be seen on FIG. 1, the formation tester 10 according to a preferred example of the invention comprises an elongate tool body 1 which is lowered in the wellbore via a cable, not shown, and stopped at a depth where a pressure measurement is desired. In a preferred embodiment of the tool of the invention, the tool body is designed to be particularly light and small, which participates to decrease the risk of differential sticking of the tool and contributes to lower the time needed to remove this tool from one place to another.

This elongate tester body comprises an eccentric portion 2 that is integral with said body, i.e. that cannot be removed or altered during the lowering in the wellbore. Typically, this eccentric portion is machined as one piece with the elongate tool body. It could also be a casted part of the formation tester body or it may also be an external part that has been welded to said body. This eccentric portion enables to create a determined standoff between the wall of the wellbore and the formation tester body, which reduces significantly the risk for said tool to remain stuck due to the differential pressure between the wellbore and the formation. The standoff depends on the size of the eccentric portion. It must be significant enough to exceed the thickness of the mudcake that covers the wall of the wellbore and which alteration, mostly due to the lowering of the tester, causes a risk of differential sticking. Considering the thickness of the mudcake that can be ½ inch or larger, depending on the permeability of the formation, mud type, drilling operations, procedure and pressure differential between the inside of the wellbore and the inside of the formation, the standoff resulting from the eccentric portion 2 may be of at least ½ inch.

In an embodiment of the formation tester according to the invention, additional standoffs 11 (see FIG. 2) may be added to the external surface of the eccentric portion of the tool body. Furthermore, other standoffs can also be added on the tool body apart anywhere else than around the eccentric portion. These standoffs will thus be helpful to avoid any sticking of the tool especially on the side opposite the eccentric portion. Any of these standoffs may be of elastomeric or metallic material and removable from the tool body such that the formation tester according to the invention can also be lowered in wells of smaller diameter. In an advantageous embodiment of the apparatus of the invention, these standoffs are coated with a non-sticking material, ex. Teflon.

A support plate 3 is carried by the external part of the eccentric portion 2. This support plate is extendible outwardly from the surface of the formation tester body by mean of probe positioners 4. The probe positioners 4 comprise, as shown as an example in FIG. 1, two pistons that are connected to a hydraulic circuit, not shown. Probes means 5 are positioned in the support plate 3 such that they contact the wall of the borehole when a pressure measurement is performed, as it will be explained here under with reference to FIG. 2. These probe means creates a passageway between the inside of said formation tester body and said formation. A sealing pad 6 surrounds said probe means in order to isolate said passageway from the wellbore during a pressure measurement. An elastomeric seal, for example, constitutes the sealing means. In the retracted position, the surfaces of the support plate 3, sealing pad and probe means are substantially at the same level than the surface of the eccentric portion 2 or lower Not represented on FIG. 1 but as known in the state of the art, the probe means 5 are connected to a flowline inside the formation tester. Said flowline is connected to pressure gauges, in order to perform pressure measurement on the formation surrounding the borehole. Furthermore, an equalization valve (not shown) enables to equalize the pressure in the flowline to the hydrostatic pressure of the fluid in the wellbore before setting the tool, and after a pressure measurement has been performed. The actuation of this valve enables to remove the tool from the wellbore wall before moving to another measurement level. A pressure sensor or gauge is used to continuously measure the hydrostatic pressure of the fluid in the wellbore. In a preferred embodiment of a formation tester according to the invention, the global volume of the flowline is minimized such that time needed to perform the pressure measurement is significantly decreased, thus leading to decreasing of the differential sticking risk.

Anchoring means 7 are positioned on the other side of the tester body, opposite the eccentric portion 2. For example, this anchoring means comprises two pistons that are connected to a hydraulic circuit, not shown. In an advantageous embodiment of a formation tester according to the invention, the motor that drives the hydraulic circuit is chosen to minimize the time needed to extend and retract said pistons in order to further reduce the time needed to perform the pressure measurements and consequently reduce the risk of differential sticking. A force imbalance exists between the probe positioners' force, on the eccentric portion side, and the anchoring means force, opposite this side. Due to this feature, the position of the formation tester according to the invention is fully controlled compared to the tester of the state of the art, wherein the position of the tool varies from time to time. The force imbalance is such that the tester always contacts the wall of the wellbore by the surface of the eccentric portion of the tool body.

Consequently, a determined standoff is always maintained between the formation tester and the wall of the formation, the size of said standoff being determined by the size of said eccentric portion. The force imbalance might be significant enough to lift the weight of the formation tester when used in horizontal or deviated wells. At least, the force imbalance should be equal to the weight of the tool. In the example wherein the probe positioners and the anchoring means comprise pistons, this force imbalance may be implemented by providing pistons of smaller diameter for said probe positioners than the diameter of the pistons for said anchoring means. Consequently, a larger part of the force provided by the hydraulic circuit will be transmitted to the anchoring means, thus creating a force imbalance.

Figure 2:
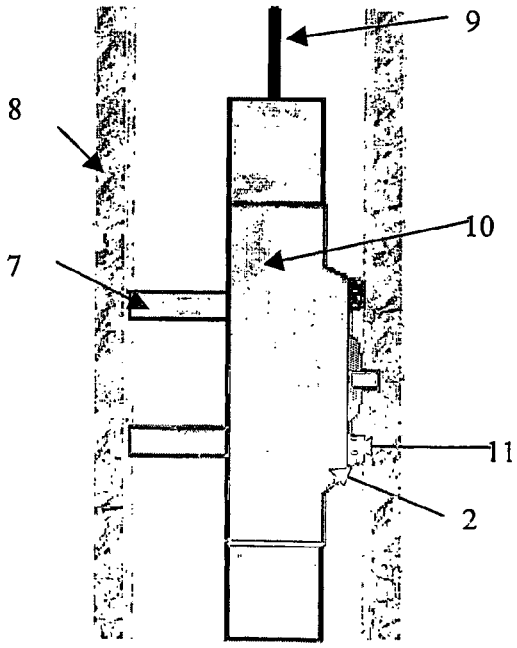
FIG. 2 represents a schematic view of the formation tester according to the invention, while performing a pressure measurement.

Referring now to FIG. 2, representing a wireline formation testing operation, the formation tester 10 according to the invention is lowered into a wellbore 8 by a wireline cable 9. While said formation tester is lowered in the wellbore, the equalization valve is open, which allows the Bowline pressure to be equal to the hydrostatic pressure of the wellbore. When the tool is settled at the measurement level, the equalization valve is closed and the measurement is started. After the pressure measurement is complete, the equalization valve is opened so that the anchoring means can be retracted and the formation tester can be moved to a new depth.

The formation tester may then be settled by anchoring the tester in place with the probe positioners and the anchoring means through the hydraulically actuated pistons. Consequently, at the level where the pressure measurement is desired, the probe positioners extend the support plate 3 outwardly from the tester body surface until it reaches the wall of the wellbore. At that moment, the probe means 5 establish fluid communication with the formation through a passageway. By the same time the anchoring means is extended from the formation tester until it contacts the wall of the wellbore opposite the support plate 3. Due to the force imbalance between the probe positioners and the anchoring means, the tool is automatically eccentered in the well, such that it contacts the wall of the wellbore only on the eccentric portion surface.

When the formation tester according to the invention is settled, the sealing pad is pressed against the wall of the wellbore, around the probe means, to isolate the interior of the tool from the wellbore fluids and the equalization valve is actuated. The point at which a seal is made between the probe means and the formation and at which fluid communication is established by the passageway between the inside of said formation tester body and said formation, is referred to as the "tool set" point. As known with conventional formation tester tools in the state of the art, fluid from the formation is then drawn into the formation tester to create a pressure drop between the flowline and the formation pressure. This volume expansion activity is referred to as a "drawdown" step.

When this drawdown stops, fluid from the formation continues to enter the probe means through the passageway until, given a sufficient time, the pressure in the flowline is the same as the pressure in the formation. This activity is referred to as a "build-up" step. The final build-up pressure, is usually assumed to be a good approximation to the formation pressure. Data generated by the pressure trace may be used to determine various formation characteristics. For example, the pressure profile measured during drawdown and build-up may be used to determine formation mobility that is the ratio of the formation permeability to the formation fluid viscosity. As already mentioned, the drawdown and buildup times can be significantly reduced by minimizing the global volume of the flowline, thus decreasing the risk of differential sticking.

After the formation pressure measurement cycle has been completed, the formation tester may be disengaged and repositioned at a different depth and the formation pressure test cycle repeated as desired. Actually, when disengagement is required, the equalization valve is opened to equalize the pressure between the flowline inside the tool and the hydrostatic pressure of the wellbore. Then, both probe positioners and anchoring means are actuated in the reverse way and enter in the inside of the tester body. The probe means are thus disengaged from the wellbore wall, the pressure in flowline increases rapidly as it equilibrates with the wellbore pressure.

Thanks to the eccentric portion 2 of the tester body, the risk of remaining stuck against the wall of the wellbore due to differential pressure is significantly lowered. Furthermore, the reduction of the tool area in contact with the wellbore and the precised positioning of the tool by mean of the force imbalance between the positioners force and the anchoring force is of significant help to overcome said risk.

The invention claimed is:

1. A formation tester for determining the formation pressure of a subsurface formation traversed by a wellbore, said formation tester comprising:

an elongate tester body (1);

a support plate (3) that is extendible outwardly from the surface of the formation tester body using a probe positioner (4), said support plate carrying probe means (5) to establish a passageway between the inside of said formation tester body and said formation, and a sealing pad (6) connected to said probe means to isolate said passage way between the inside of said formation tester body and said formation;

anchoring means (7) to settle said tester body at a level within the wellbore;

wherein said elongate tester body comprises an eccentric portion (2) wherein said support plate is mounted such that a determined standoff is maintained between said elongate tester body (1) and the wall (8) of the wellbore when said tester body is settled at a level in the wellbore, and wherein additional standoff means (11) are secured on said elongate tester body, said additional standoff means being removable, and wherein the anchoring means (7) are situated on the side of the tester body opposite to the support plate and wherein there is an imbalance between the anchoring force and the force applied by the probe positioner (4) such that the only contact with the wall of the wellbore will be the eccentric portion.

2. A formation tester according to claim 1, wherein the probe positioner (4) is mounted on a first side of said eccentric portion (2) and extend the support plate (3) outwardly from the surface of the formation tester body towards the wall of the wellbore.

3. A formation tester according to claim 2, wherein the force imbalance is such that the anchoring means press the surface of the eccentric portion (2) of the tool body against the wall of the borehole.

4. A formation tester according to claim 2, wherein the force imbalance is equal or higher than the weight of said formation tester.

5. A formation tester body according to claim 2, wherein a hydraulic circuit actuates both the probe positioner and the anchoring means, said hydraulic circuit being designed to minimize the time needed to extend the support plate and settle the tool body.

6. A formation tester body according to claim 1, wherein the probe positioner and the anchoring means comprise pistons connected to said hydraulic circuit, the pistons from said probe positioner being of smaller diameter than the diameter of the pistons from said anchoring means.

7. A formation tester according to claim 1, wherein the eccentric portion of the tester body is an integral part of the elongate tester body.

8. A formation tester according to claim 1, wherein the degree of standoff of the eccentric portion of the tester body is such that the resulting standoff provided between the elongate tester body and the wall of the wellbore is at least one half of an inch.

9. A formation tester according to claim 1, wherein the probe means are connected to a pressure sensor that communicates with the passageway between the inside of the formation tester body and the formation.

10. A formation tester body according to claim 1, wherein additional standoff means (11) are secured on said elongate tester body, said additional standoff means being removable.

11. A formation tester according to claim 10, wherein said additional standoff means are coated with a non-sticking material.

12. A method for performing a formation pressure test of a subsurface formation traversed by a wellbore, said method comprising the following steps:

lowering an elongate formation tester body inside said wellbore;

stopping said formation tester body at a level wherein a pressure test is to be performed;

extending a support plate at said level outwardly from the surface of the formation tester body towards the wall of the wellbore using a probe positioner (4);

extending anchoring means to settle said formation tester body in the wellbore;

pressing a sealing pad and probe means carried by said support plate against the wall of the wellbore to establish a passageway between the inside of said formation tester body and said formation and isolate said passageway from the wellbore;

performing a formation pressure test, wherein the method further comprises the step of maintaining a determined standoff between the formation tester body and the wall of the wellbore against which said probe means and sealing pad are pressed by means of an eccentric portion of said formation tester body and wherein additional standoff means (11) are secured on said elongate tester body, said additional standoff means being removable, and wherein the anchoring means (7) are situated on the side of the tester body opposite to the support plate and wherein there is an imbalance between the anchoring force and the force applied by the probe positioner (4) such that the only contact with the wall of the wellbore will be the eccentric portion.

13. A method according to claim 12, wherein the force imbalance is equal or higher than the weight of the formation tester body.

14. A method according claim 12, wherein a hydraulic circuit actuates both probe means and anchoring means, said force imbalance been created by this hydraulic circuit.

15. A method according to claim 14, wherein the hydraulic circuit is designed to minimize the time needed to extend and retract the support plate and the anchoring means.

16. A method according to claim 12, wherein said probe means are connected with a flowline inside said formation tester, the volume of said flowline been chosen to minimize the time needed to perform the formation pressure test.

17. A formation tester for determining the formation pressure of a subsurface formation traversed by a wellbore, said formation tester comprising:

an elongate tester body (1) having an eccentric portion;

a support plate (3) that is extendible outwardly from the surface of the formation tester body using probe positioning means (4) mounted an a side of said eccentric portion, said support plate carrying probe means (5) and a sealing pad (6) connected to said probe means;

anchoring means (7) to settle said tester body at a level within the wellbore; and wherein the anchoring means are situated on a side that is opposite to the side of the eccentric portion and wherein an imbalance there is an imbalance between the anchoring force and the force applied by the probe positioning means such that the anchoring means press the surface of the eccentric portion (2) of the tool body against the wall of the borehole such that the only contact with the wall of the wellbore will be the eccentric portion.

* * * * *